US008561262B1

(12) United States Patent
Liang et al.

(10) Patent No.: US 8,561,262 B1
(45) Date of Patent: Oct. 22, 2013

(54) DAMPING DEVICE FOR HINGE ASSEMBLY

(71) Applicants: King Slide Works Co., Ltd., Kaohsiung (TW); King Slide Technology Co., Ltd., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW); Yi-Syuan Jhao, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 13/719,463

(22) Filed: Dec. 19, 2012

(51) Int. Cl.
*E05F 1/08* (2006.01)
*E05D 11/10* (2006.01)

(52) U.S. Cl.
USPC ..... 16/286; 16/296

(58) Field of Classification Search
USPC ..... 16/286, 282, 284, 287, 288, 296
See application file for complete search history.

(56) References Cited

U.S. PATENT DOCUMENTS

| | | | | | |
|---|---|---|---|---|---|
| 2,814,067 | A * | 11/1957 | Bowden | 16/66 |
| 4,050,116 | A * | 9/1977 | Salice | 16/288 |
| 4,724,578 | A * | 2/1988 | Toyama | 16/240 |
| 4,760,623 | A * | 8/1988 | Toyama | 16/238 |
| 5,269,043 | A * | 12/1993 | Yang | 16/68 |
| 5,369,841 | A * | 12/1994 | Bembnowski | 16/278 |
| 5,604,956 | A * | 2/1997 | Grass | 16/278 |
| 5,655,261 | A * | 8/1997 | Cress | 16/286 |
| 6,360,401 | B1 * | 3/2002 | Salice | 16/335 |
| 6,859,979 | B2 * | 3/2005 | Egger et al. | 16/327 |
| 7,065,833 | B2 * | 6/2006 | Kropf | 16/286 |
| 7,096,535 | B2 * | 8/2006 | Lin | 16/287 |
| 7,614,116 | B2 * | 11/2009 | Chen et al. | 16/238 |
| 7,730,582 | B2 * | 6/2010 | Migli | 16/286 |
| 7,735,195 | B2 * | 6/2010 | Brown et al. | 16/286 |
| 7,748,082 | B2 * | 7/2010 | Harald et al. | 16/286 |
| 7,878,468 | B2 * | 2/2011 | Chen et al. | 248/220.41 |
| 7,966,696 | B2 * | 6/2011 | Krammer | 16/286 |

(Continued)

FOREIGN PATENT DOCUMENTS

| | | | |
|---|---|---|---|
| JP | 3179893 U | * | 11/2012 |
| WO | WO 2004020771 | * | 3/2004 |

(Continued)

OTHER PUBLICATIONS

WO 2012024711 A1—Machine Translation.*

*Primary Examiner* — Victor Batson
*Assistant Examiner* — Jason W San
(74) *Attorney, Agent, or Firm* — Rosenberg, Klein & Lee

(57) ABSTRACT

A hinge assembly includes a housing, an arm and at least one spring. A damping device includes a damper having a piston rod, a maintaining member secured in the housing and an adjustment member. The adjustment member is movably connected to the maintaining member and has a protruded portion located corresponding to the piston rod of the damper. When the adjustment member is moved to a first position relative to the maintaining member, the protruded portion of the adjustment member is located toward the piston rod of the damper, so that the piston rod contacts the protruded portion and retracts to perform damping function. When the adjustment member is moved to a second position relative to the maintaining member, the protruded portion of the adjustment member is moved away from the piston rod of the damper, and no damping function is available.

15 Claims, 16 Drawing Sheets

(56) References Cited

U.S. PATENT DOCUMENTS

| | | | | |
|---|---|---|---|---|
| 8,146,206 | B2 * | 4/2012 | Lautenschlager | 16/286 |
| 8,205,298 | B2 * | 6/2012 | Lin et al. | 16/287 |
| 8,424,161 | B2 * | 4/2013 | Sutterlutti | 16/286 |
| 2007/0251058 | A1 * | 11/2007 | Fitz et al. | 16/287 |
| 2008/0078899 | A1 * | 4/2008 | Chen et al. | 248/220.21 |
| 2008/0172834 | A1 * | 7/2008 | Sutterlutti | 16/286 |
| 2008/0250604 | A1 * | 10/2008 | Chen et al. | 16/225 |
| 2008/0271291 | A1 * | 11/2008 | Chen et al. | 16/238 |
| 2009/0119875 | A1 * | 5/2009 | Migli | 16/233 |
| 2010/0072153 | A1 * | 3/2010 | Chen et al. | 211/183 |
| 2011/0005032 | A1 * | 1/2011 | Domenig et al. | 16/54 |
| 2011/0291538 | A1 * | 12/2011 | Brunnmayr | 312/326 |
| 2013/0119215 | A1 * | 5/2013 | Chen et al. | 248/220.21 |

FOREIGN PATENT DOCUMENTS

| | | | |
|---|---|---|---|
| WO | WO 2007009899 | A1 * | 1/2007 |
| WO | 2012024702 | A1 | 3/2012 |
| WO | 2012024711 | A1 | 3/2012 |
| WO | WO 2012024702 | A1 * | 3/2012 |
| WO | WO 2012024711 | A1 * | 3/2012 |
| WO | 2012045102 | A1 | 4/2012 |
| WO | WO 2012045102 | A1 * | 4/2012 |

* cited by examiner

DAMPING DEVICE FOR HINGE ASSEMBLY

FIELD OF THE INVENTION

The present invention relates to a damping device, and more particularly, to a damping device for a hinge assembly.

BACKGROUND OF THE INVENTION

WO/2012/024702 A1 discloses a "DAMPING DEVICE FOR FURNITURE PARTS" and comprises a damping device used on furniture parts. The damping device 9 as disclosed in FIGS. 4a and 4b of the prior invention comprises a housing 12, a slider 13 and a locking device 15, wherein the slider 13 has a locking member 19 extending therefrom.

FIG. 5a shows that there is a space between the piston 22 and the fluid chamber 21 of the slider 13, so that when the inclined abutment surface 16 of the slider is touched, the slider 13 moves relative to the piston 22 so as to have the damping feature.

FIG. 5c shows that the locking element 15a of the locking device 15 contacts the locking member 19 of the slider 13, so that the slider 13 retracts relative to the piston 22 and is positioned. Therefore, as shown in FIG. 6b, the slider 13 of the damping device 9 does not protrude automatically, so that the arm 7 cannot touch the slider 13, and no damping function is available.

However, the damping function is made by forcing the fluid chamber 21 of the slider 13 to move to the end having the piston 22, and the slider 13 is positioned by the contact between the locking element 15a of the locking device 15 and the locking member 19 of the slider 13. The action to force the slider 13 to move is necessary and which is an extra operation action.

The present invention intends to provide a damping device for a hinge assembly and improves the shortcomings of the conventional damping device.

SUMMARY OF THE INVENTION

The present invention relates to a hinge assembly and comprises a housing having a chamber defined therein, and an arm is pivotably connected to the housing. A spring is located in the chamber to provide to allow the pivotal movement between the housing and the arm. A damping device comprises a maintaining member secured in the chamber of the housing, and the maintaining member has a path in which a damper is located. The damper has a piston rod. An adjustment member is movably connected to the maintaining member and has a protruded portion which is protruded into the maintaining member and located corresponding to the piston rod of the damper.

When the adjustment member is moved to a first position relative to the maintaining member, the protruded portion of the adjustment member is located toward the piston rod of the damper. When the housing is closed relative to the arm, the damper is pushed by the arm, so that the piston rod of the damper contacts the protruded portion of the adjustment member and retracts to perform damping function.

When the adjustment member is moved to a second position relative to the maintaining member, the protruded portion of the adjustment member is moved away from the piston rod of the damper. When the housing is closed relative to the arm, the piston rod of the damper cannot contact the protruded portion of the adjustment member, and no damping function is available.

Preferably, the adjustment member has a protrusion, the maintaining member has a top portion which has a first contact portion and a second contact portion on the periphery thereof. When the adjustment member is moved to the first position relative to the maintaining member, the protrusion of the adjustment member contacts the first contact portion of the maintaining member. When the adjustment member is moved to the second position relative to the maintaining member, the protrusion of the adjustment member contacts the second contact portion of the maintaining member.

Preferably, the first contact portion of the maintaining member is a fixed surface, and the second contact portion of the maintaining member is a resilient latch.

Preferably, a resilient member is connected between the maintaining member and the adjustment member, and the adjustment member is maintained at the first position in response to the resilient member.

Preferably, the maintaining member has a first hook, the adjustment member has a second hook, and the resilient member is hooked between the first and second hooks.

Preferably, both of the first and second contact portions of the maintaining member are two resilient latches.

Preferably, the maintaining member has a bottom portion which has a curved lip on the periphery thereof. The maintaining member has a body connected between the top portion and the bottom portion. The adjustment member has a top piece, a bottom piece and a side panel which is connected between the top and bottom pieces. The top piece of the adjustment member contacts the top portion of the maintaining member. The bottom piece of the adjustment member contacts the lip of the bottom portion of the maintaining member.

Preferably, the top piece of the adjustment member has an operation portion.

Preferably, the top portion of the maintaining member has a first index and a second index. The top piece of the adjustment member has a tip. When the adjustment member is moved to the first position relative to the maintaining member, the tip points the first index. When the adjustment member is moved to the second position relative to the maintaining member, the tip points the second index.

Preferably, the first index is represented by a description "ON" marked thereon, and the second index is represented by a description "OFF" marked thereon.

Preferably, the path of the maintaining member has a linear guide section defined in the inside thereof. The damper has a stop which is located to contact an end of the guide section.

Preferably, the chamber of the housing has two positioning holes, and the maintaining member has two engaging members on two sides thereof. The two engaging members are engaged with the positioning holes to secure the maintaining member in the chamber of the housing.

Preferably, the chamber of the housing is defined by two side walls, an inner bottom, a front wall and a rear wall. The front wall is connected to the front end of the two side walls. The rear wall is connected to the rear end of the side walls. Each of the side walls of the housing has a pivotal hole. The two pivotal holes are located adjacent to the front wall. The arm has two cam portions and a reception portion which is connected between the two cam portions. A pivot extends through the pivotal holes and the reception portion to pivotably connect the arm to the housing.

Preferably, there are two springs which are torsion springs, and each spring has a first leg, a second leg and a coil portion connected between the first and second legs. The housing has two pin holes in the side walls, and the inner bottom has two lugs. Each lug has a through hole which is located corresponding to the pin hole corresponding thereto. The springs are connected between the side walls of the housing and the lugs. A pin extends through one of the pin holes, one of the coil portions of the springs and one of the through holes of the lugs to connect one of the springs to the housing.

Preferably, the two side walls each have an insertion hole, and the two respective second legs of the two springs are inserted into the two insertion holes.

One aspect of the present invention is to provide a mechanism for the user to easily and conveniently choose turning on or turning off the damping function of the damping device for the hinge assembly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
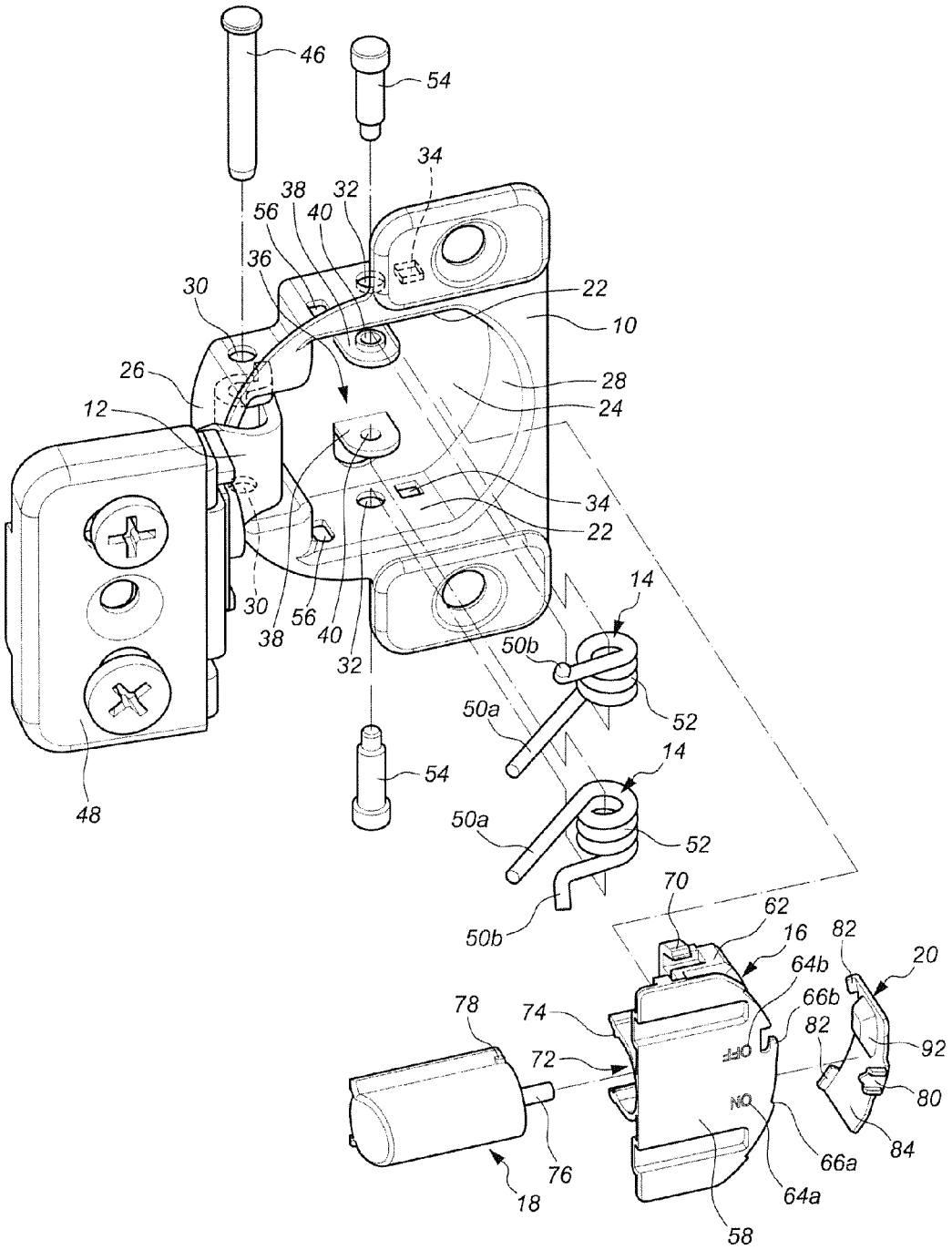
FIG. 1 is an exploded view to show the damping device and the hinge assembly of the present invention.
Figure 2:
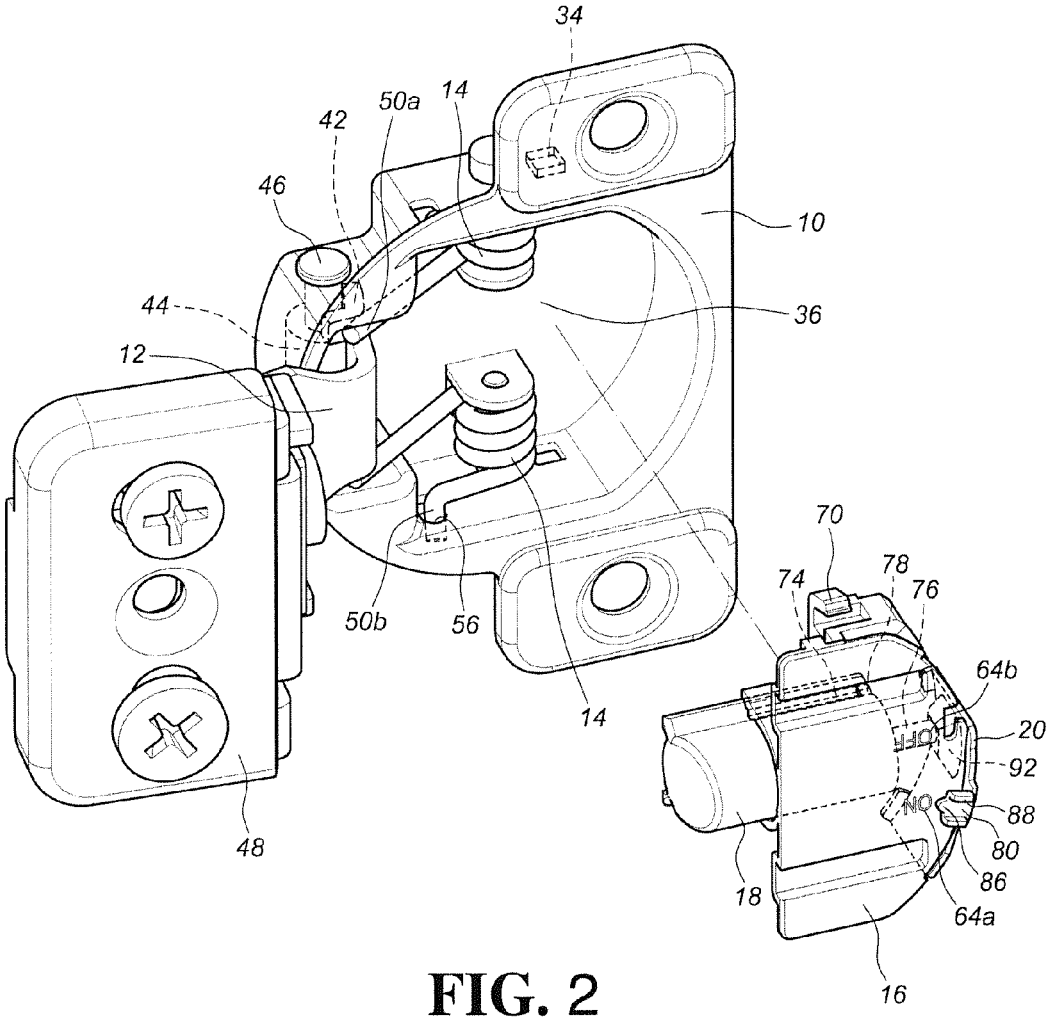
FIG. 2 is another exploded view to show the damping device and the hinge assembly of the present invention.
Figure 3:
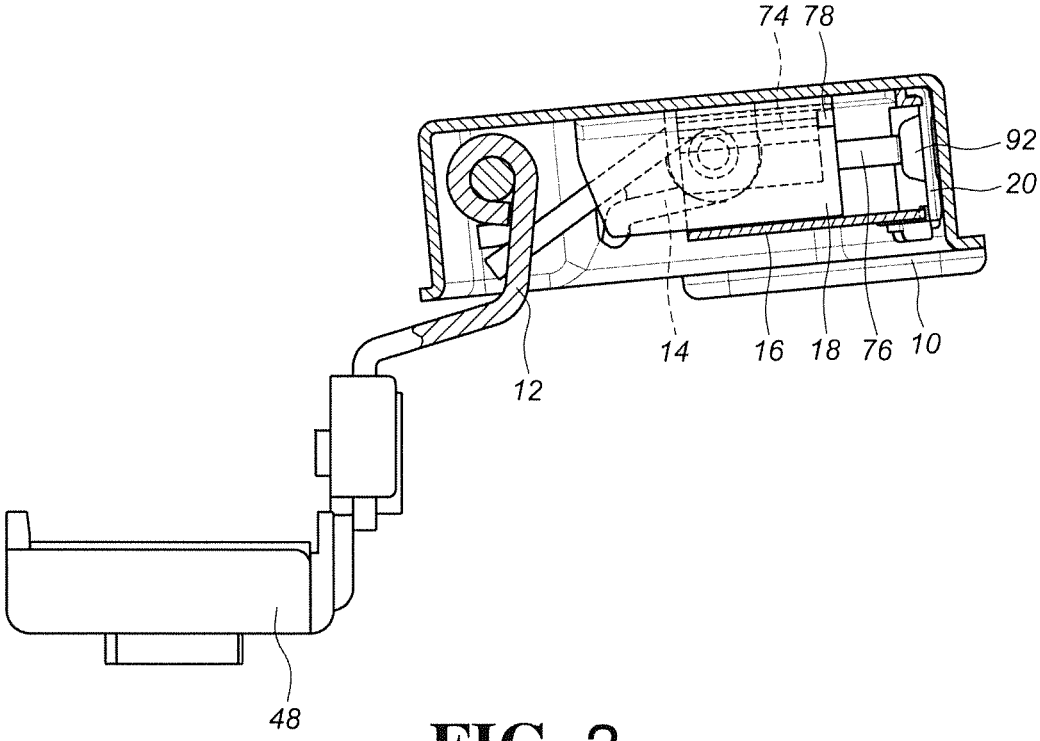
FIG. 3 is a partial cross sectional view of the hinge assembly of the present invention, wherein the damping device is installed in the hinge assembly.

Referring to FIGS. 1 to 3, the hinge assembly of the present invention comprises a housing 10, an arm 12, at least one spring 14, a maintaining member 16, a damper 18 and an adjustment member 20.

The housing 10 comprises two side walls 22, an inner bottom 24, a front wall 26 and a rear wall 28, wherein the side walls 22 of the housing 10 have two pivotal holes 30, and the two pivotal holes 30 are located adjacent to the front wall 26. The side walls 22 further have two pin holes 32 and two positioning holes 34. The inner bottom 24 is connected between the two side walls 22. Preferably, the inner bottom 24 is connected to the side walls 22, the front wall 26 and the rear wall 28. The front wall 26 is connected to the front end of the two side walls 22, and the rear wall 28 is connected to the rear end of the side walls 22. The chamber 36 of the housing 10 is defined by the two side walls 22, the inner bottom 24, the front wall 26 and the rear wall 28. The inner bottom 24 has two lugs 38, and each lug 38 has a through hole 40 which is located corresponding to the pin hole 32 corresponding thereto.

The arm 12 is pivotably connected to the housing 10 and has two cam portions 42 and a reception portion 44 which is connected between the two cam portions 42. A pivot 46 extends through the pivotal holes 30 of the side walls 22 of the housing 10 and the reception portion 44 of the arm 12 to pivotably connect the arm 12 to the housing 10. An installation member 48 is connected to the arm 12 so as to be installed to a piece of furniture such as a cabinet.

The at least one spring 14 is located in the chamber 36 to provide a force to allow the pivotal movement between the housing 10 and the arm 12. In the embodiment, there are two springs 14 which are torsion springs. Each spring 14 has a first leg 50*a*, a second leg 50*b* and a coil portion 52 connected between the first and second legs 50*a*, 50*b*. Each spring 14 is connected between the side wall 22 and the lug 38. The housing 10 has two pin holes 32 in the side walls 22. A pin 54 extends through one of the pin holes 32, one of the coil portions 52 of the springs 14 and one of the through holes 40 of the lugs 38 to position one of the springs 14 in the chamber 36 of the housing 10. The first and second legs 50*a*, 50*b* of the two springs 14 respectively contact the cam portions 42 of the arm 12 and the side walls 22 of the housing 10. Preferably, each of the side walls 22 has an insertion hole 56, and the second legs 50*b* are inserted in the insertion holes 56. When the housing 10 is closed relative to the arm 12, the springs 14 provide a force to complete the closing action.

Figure 4:
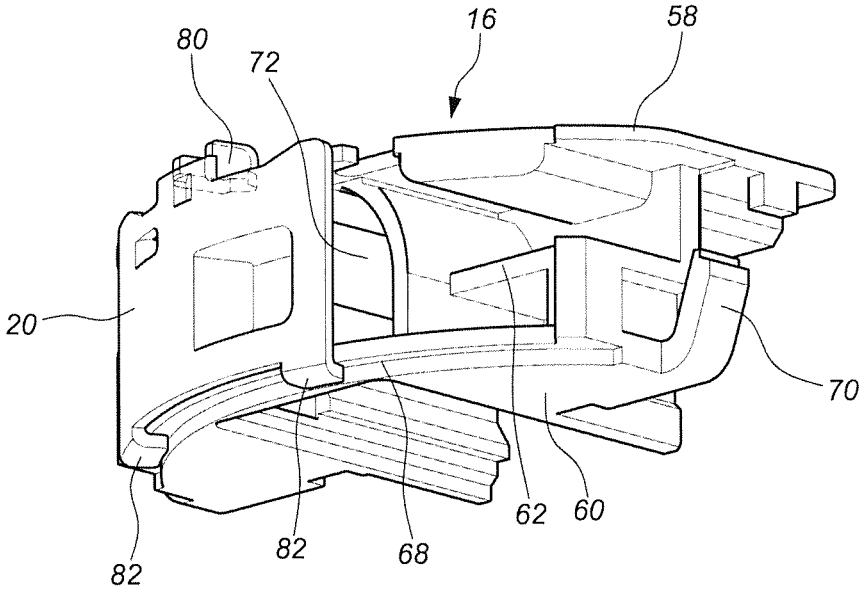
FIG. 4 is a perspective view to show the adjustment member and the maintaining member of the present invention.

As shown in FIGS. 1 and 4, the maintaining member 16 is secured in the chamber 36 of the housing 10 and has a top portion 58, a bottom portion 60 and a body 62 connected between the top and bottom portions 58, 60. The top portion 58 of the maintaining member 16 has a first index 64*a* and a second index 64*b*. Preferably, the first index 64*a* is represented by a description "ON" marked thereon, and the second index 64*b* is represented by a description "OFF" marked thereon. The rear wall 28 has a first contact portion 66*a* and a second contact portion 66*b* on the periphery thereof. The first contact portion 66*a* of the maintaining member 16 is a fixed surface, and the second contact portion 66*b* of the maintaining member 16 is a resilient latch. The bottom portion 60 of the maintaining member 16 has a curved lip 68 on the periphery thereof. The maintaining member 16 has two engaging members 70 on two sides thereof, and the two engaging members 70 are engaged with the positioning holes 34 to secure the maintaining member 16 in the chamber 36 of the housing 10. The body 62 of the maintaining member 16 has a path 72. Preferably, the path 72 has a linear guide section 74 defined in the inside thereof. The damper 18 is located in the path 72 and located corresponding to the arm 12. Preferably, the damper 18 has a piston rod 76 and a stop 78, wherein the piston rod 76 contacts the adjustment member 20, and the stop 78 is located to contact an end of the guide section 74.

Figure 5:
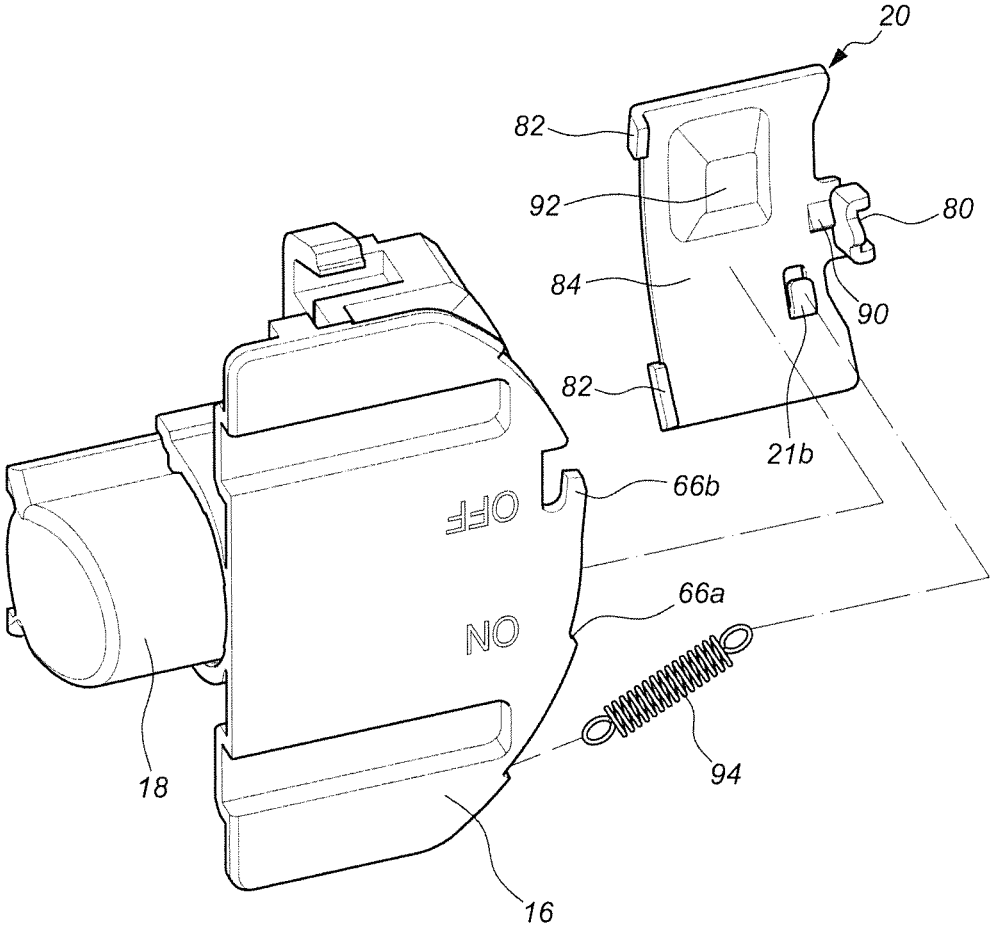
FIG. 5 shows that a resilient member is connected to the maintaining member and the adjustment member.
Figure 6:
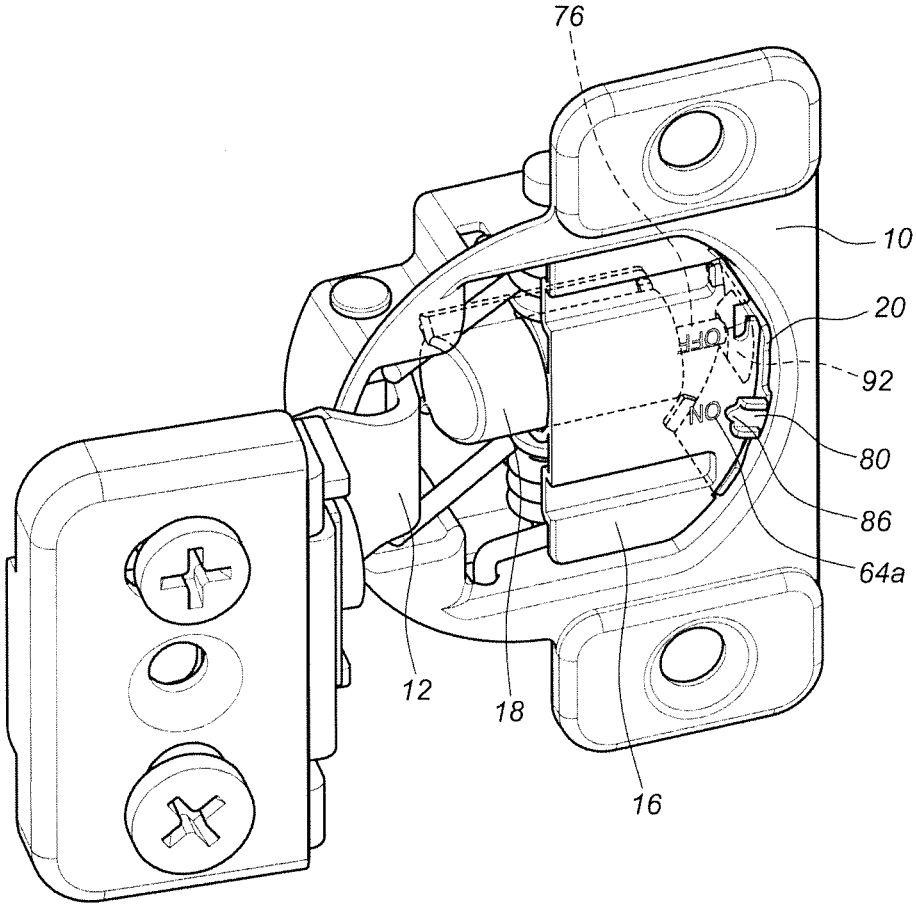
FIG. 6 is the perspective view of the hinge assembly wherein the adjustment member is moved to the first position relative to the maintaining member.

The adjustment member 20 is movably connected to the maintaining member 16 and comprises a top piece 80, a bottom piece 82 and a side panel 84 connected between the top and bottom pieces 80, 82. As shown in FIG. 4, the top piece 80 of the adjustment member 20 contacts the top portion 58 of the maintaining member 16, and the bottom piece 82 of the adjustment member 20 contacts the bottom portion 60 of the maintaining member 16. Preferably, the bottom piece 82 contacts the curved lip 68 of the bottom portion 60. The top piece 80 of the adjustment member 20 has a tip 86 on the front end thereof, and the top piece 80 further has an operation portion 88 on the top thereof, such as a pair of bent portions, so that the user can easily shift the adjustment member 20 by the user's finger(s). As shown in FIG. 5, two bottom pieces 82 are separately arranged on the adjustment member 20. The side panel 84 has a protrusion 90 and a protruded portion 92. The protrusion 90 is located adjacent to the top piece 80 and located corresponding to the first and second contact portions 66*a*, 66*b* of the maintaining member 16. The protruded portion 92 which is protruded into the maintaining member 16 and located corresponding to the piston rod 76 of the damper 18, as shown in FIG. 6. The tip 86 points the first index 64*a* (ON) or the second index 64*b* (OFF) to indicate whether or not the protruded portion 92 of the adjustment member 20 contacts the piston rod 76 of the damper 18 to perform damping function.

Figure 7:
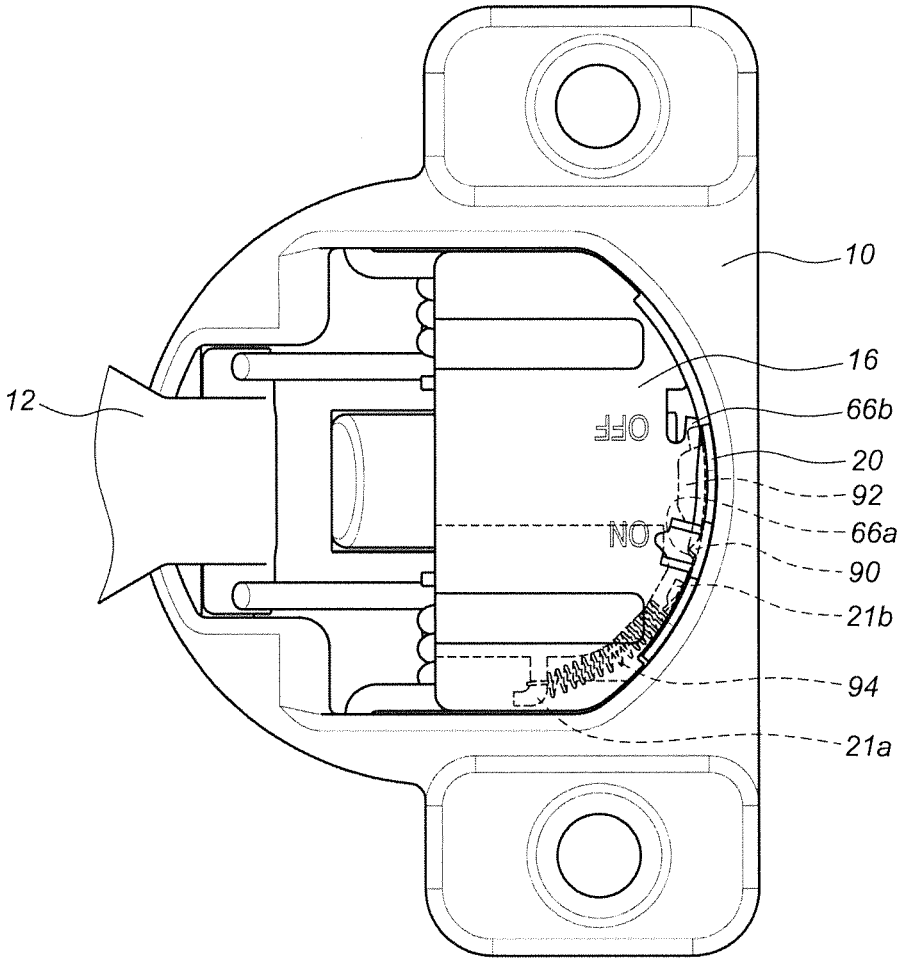
FIG. 7 shows that the adjustment member is moved to the first position relative to the maintaining member.
Figure 8:
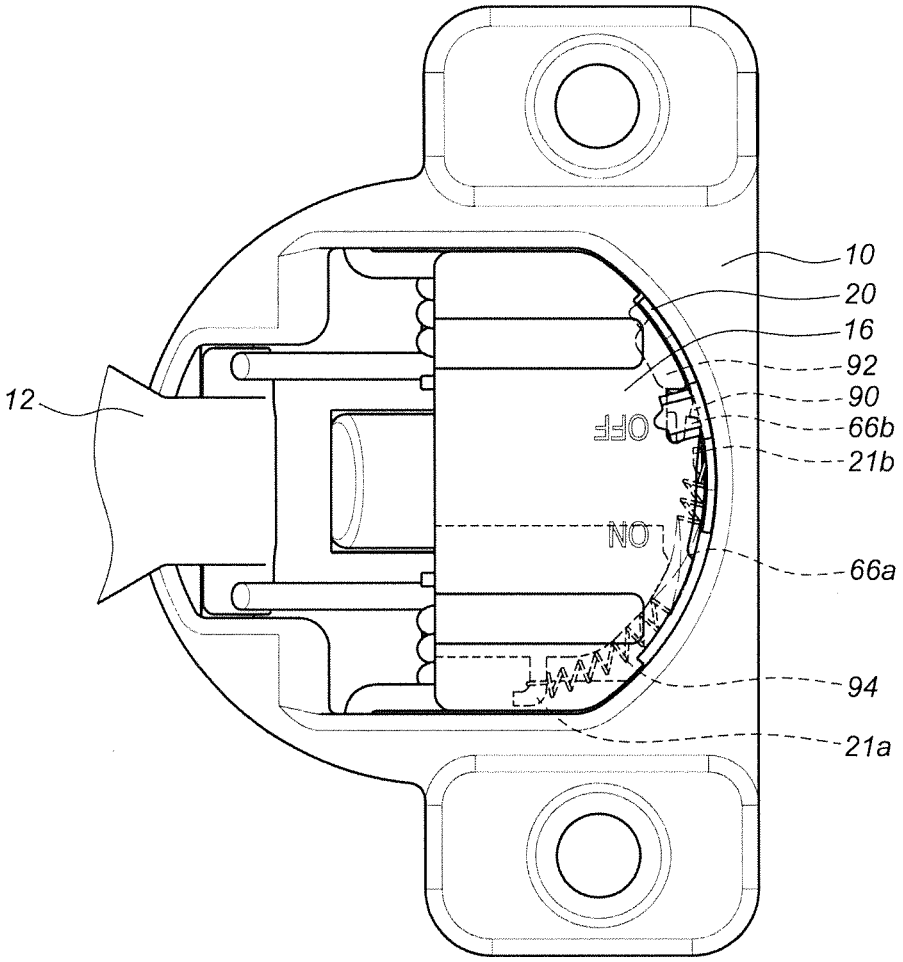
FIG. 8 shows that the adjustment member is moved to the second position relative to the maintaining member.

As shown in FIGS. 6 and 7, when the adjustment member 20 is moved to a first position relative to the maintaining member 16, the protrusion 90 of the adjustment member 20 contacts the first contact portion 66*a* of the maintaining member 16, the protruded portion 92 of the adjustment member 20 is located to face to the piston rod 76 of the damper 18, and the tip 86 points the first index 64*a* (ON) on the maintaining member 16. Consequently, when the housing 10 closes relative to the arm 12, the damper 18 is pushed by the arm 12, so that the piston rod 76 of the damper 18 contacts the protruded portion 92 of the adjustment member 20 and retracts to perform damping function. In one preferable embodiment, as shown in FIGS. 5 and 7, a resilient member 94 is connected between the maintaining member 16 and the adjustment member 20. The maintaining member 16 has a first hook 21*a*, the adjustment member 20 has a second hook 21*b*, and the resilient member 94 is hooked between the first and second hooks 21*a*, 21*b*, so that the adjustment member 20 is maintained at the first position in response the force of the resilient member 94. As shown in FIG. 8, when the adjustment member 20 is moved to the second position relative to the maintaining member 16, the protrusion 90 of the adjustment member 20 is moved away from the first contact portion 66*a* and contacts the second contact portion 66*b*, and the adjustment member 20 stretches the resilient member 94.

Figure 9:
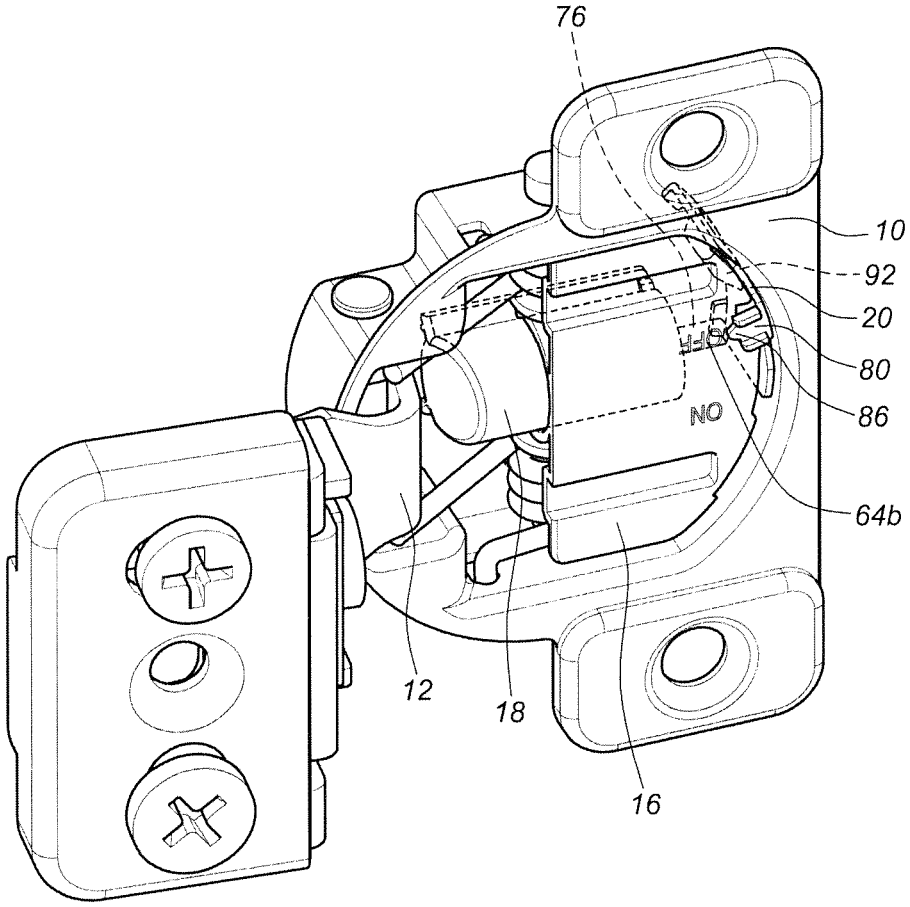
FIG. 9 is the perspective view of the hinge assembly wherein the adjustment member is moved to the second position relative to the maintaining member.
Figure 10:
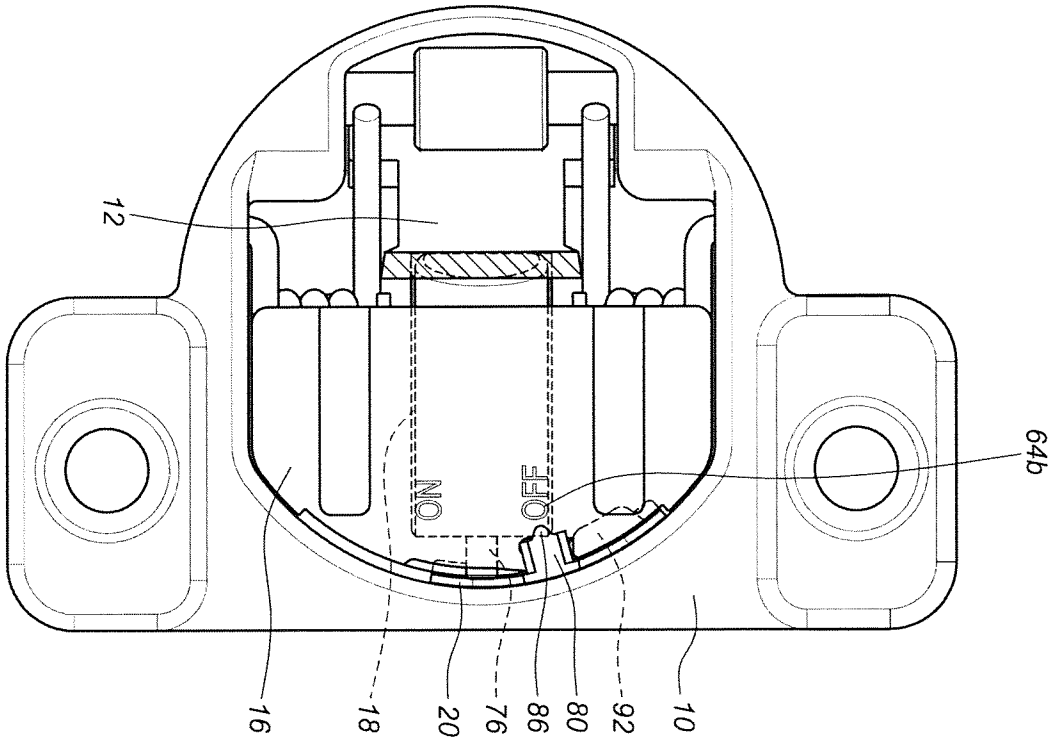
FIG. 10 shows that the corresponding position of the adjustment member, the damper and the piston rod when the housing is closed relative to the arm, wherein the damping function is not available.

FIG. 9 shows that when the adjustment member 20 is moved to a second position relative to the maintaining member 16, the protruded portion 92 of the adjustment member 20 is moved away from the piston rod 76 of the damper 18, and the tip 86 points the second index 64*b* (OFF) of the maintaining member 16. As shown in FIG. 10, when the housing 10 is closed relative to the arm 12, although the damper 18 is moved by the arm 12 and shifts relative to the maintaining member 16, the piston rod 76 and the damper 18 are integrally moved toward the adjustment member 20 without any compression between the piston rod 76 and the damper 18. That is to say, the piston rod 76 cannot contact the protruded portion 92 of the adjustment member 20, so that no damping function is available.

Figure 11:
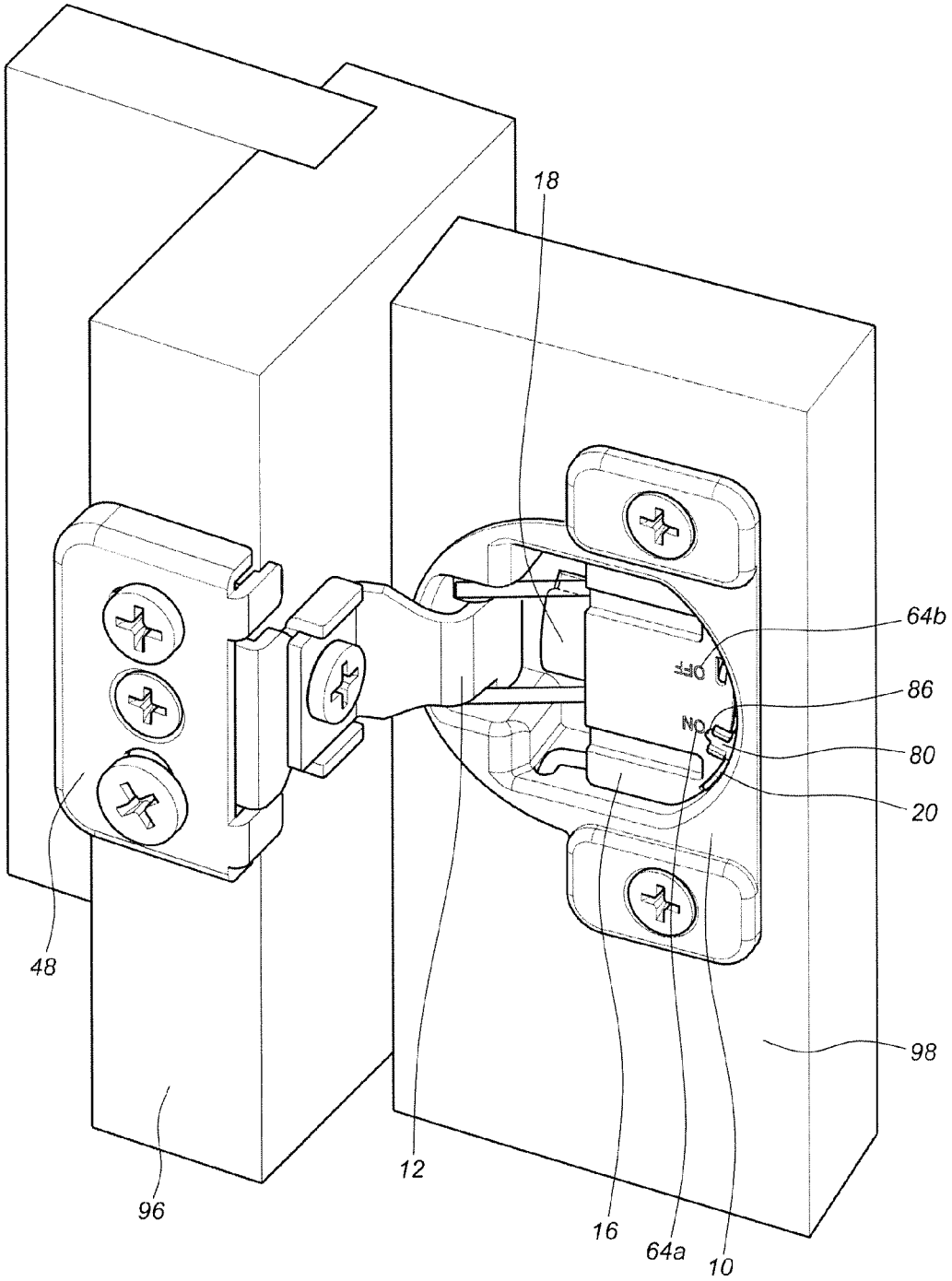
FIG. 11 shows that the hinge assembly of the present invention is installed to the cabinet and the door, wherein the door is opened and the damping function is available.
Figure 12:
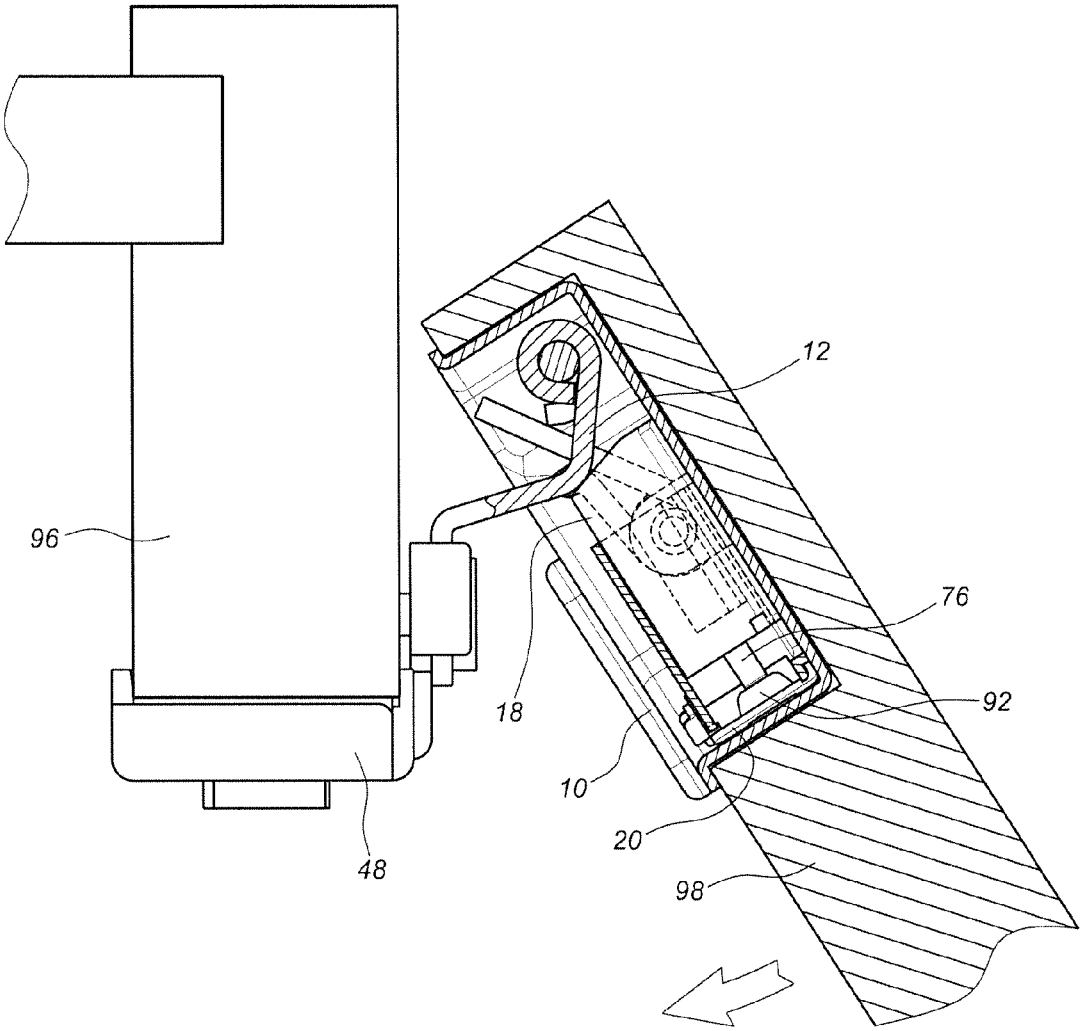
FIG. 12 shows that the door is pivoted an angle during closing action relative to the cabinet, wherein the damping function is available.
Figure 13:
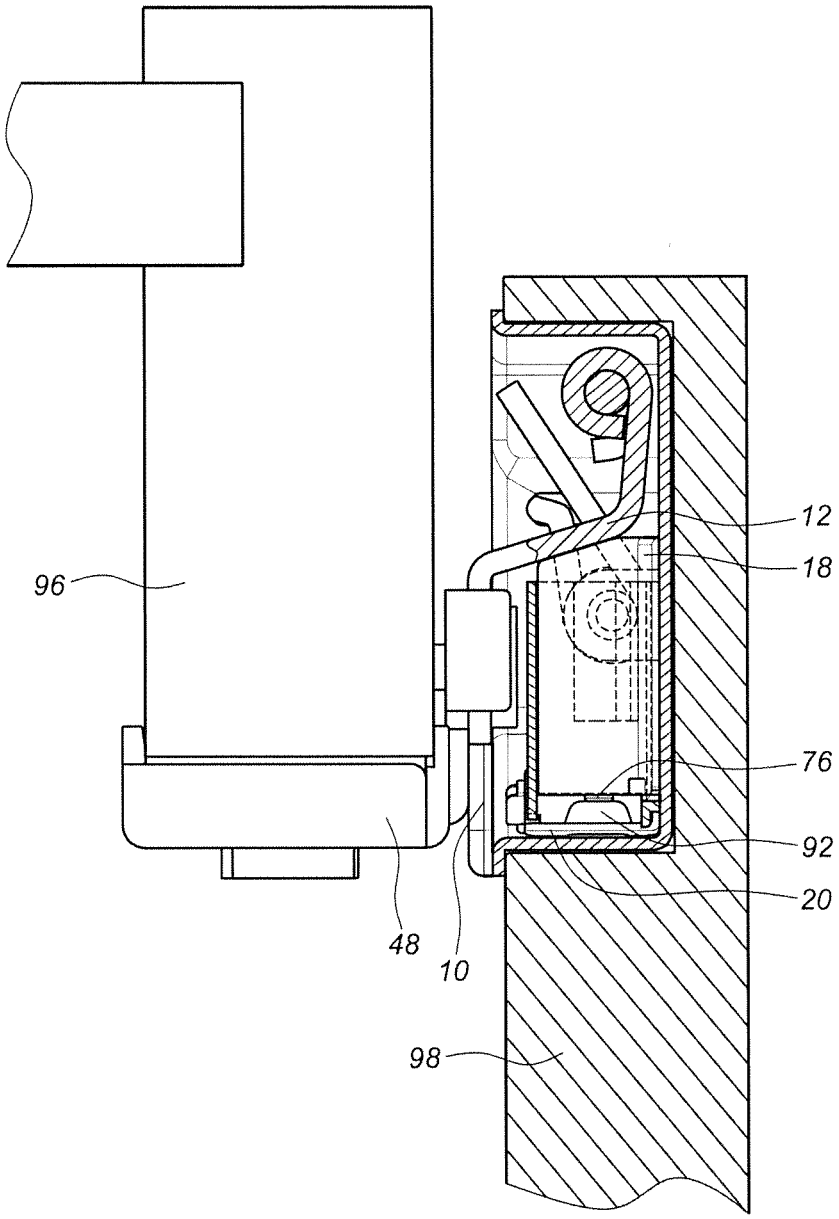
FIG. 13 shows that the door is completely closed relative to the cabinet, wherein the damping function is available.

As shown in FIG. 11, the arm 12 is connected to a cabinet 96 by the installation member 48, and the housing 10 is connected to a door 98. The user can adjust the adjustment member 20 to let the protruded portion 92 point the piston rod 76 of the damper 18, so that when the door 98 is moved to a closed position relative to the cabinet 96, as shown in FIGS. 12 and 13, the arm 12 contacts the damper 18 whose piston rod 76 contacts the protruded portion 92 of the adjustment member 20. The piston rod 76 retracts relative to the damper 18 to have the damping function. Therefore, the door 98 is slowly and quietly closed relative to the cabinet 96.

Figure 14:
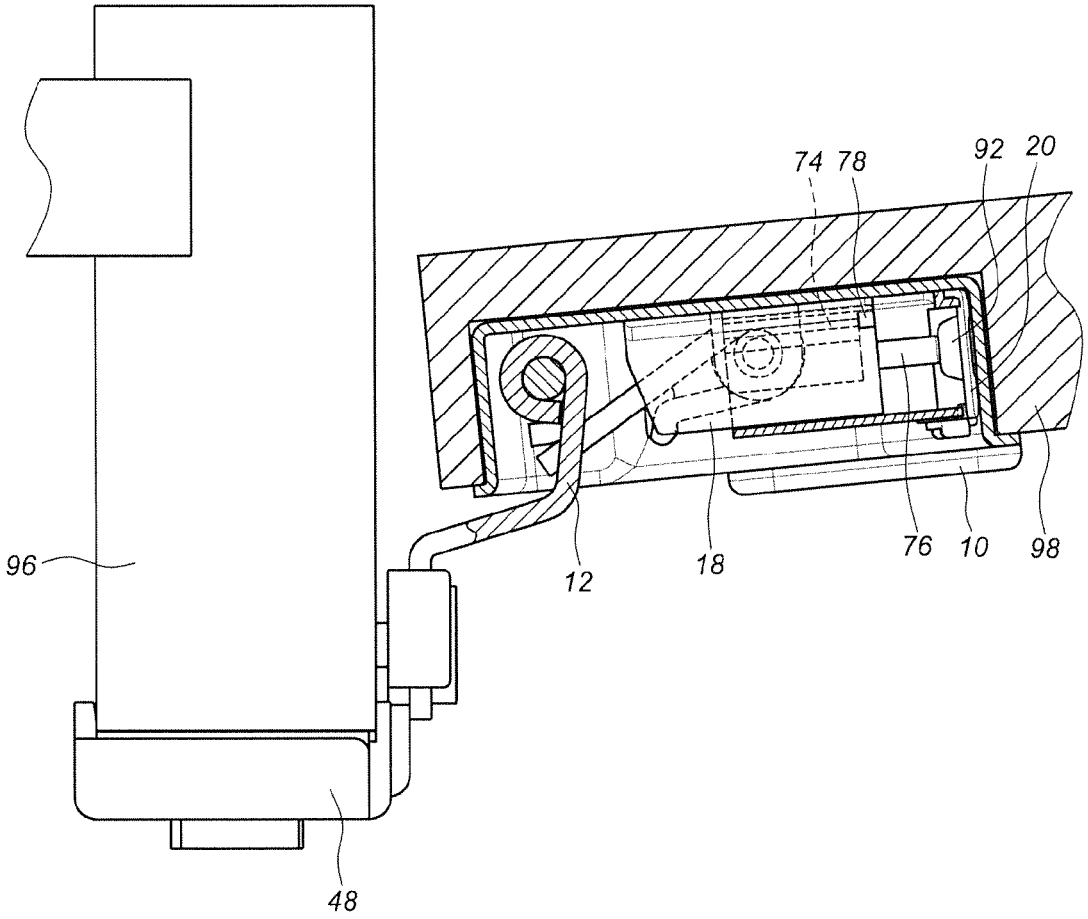
FIG. 14 shows that the door of the cabinet is opened, wherein the damping device is restoration and the damping function is available.

FIG. 14 shows that when the door 98 is opened relative to the cabinet 96, the arm 12 is moved away from the damper 18, and the piston rod 76 extends and contacts the protruded portion 92 of the adjustment member 20 to move the damper 18 until the stop 78 of the damper 18 contacts the end of the linear guide section 74 of the maintaining member 16. At this position, the damper 18 can be pushed to perform damping function relative to the arm 12.

Figure 15:
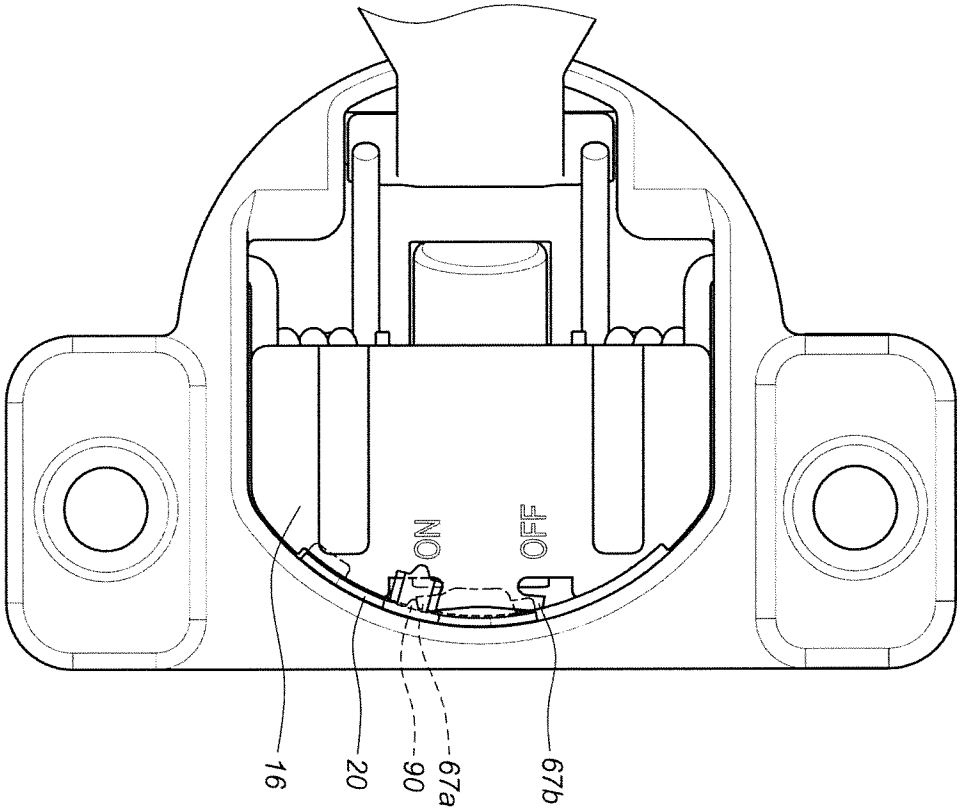
FIG. 15 shows a second embodiment of the maintaining member wherein the first contact portion contacts the adjustment member at the first position.
Figure 16:
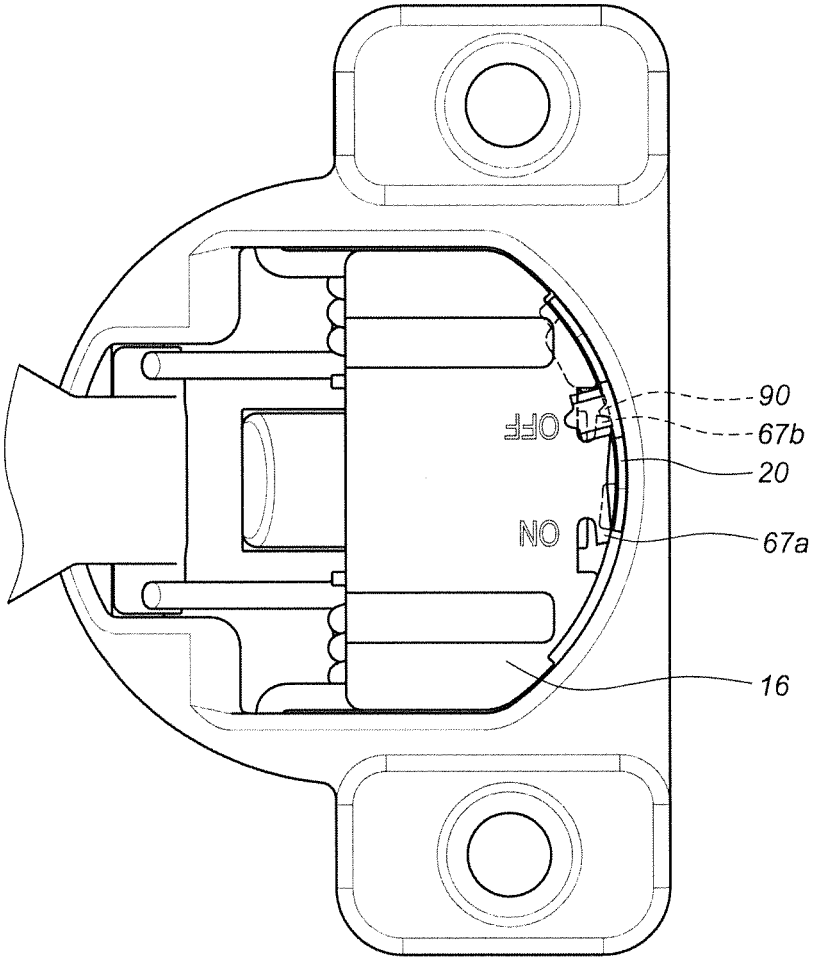
FIG. 16 shows the second embodiment of the maintaining member wherein the first contact portion contacts the adjustment member at the second position.

The second embodiment is disclosed in FIGS. 15 and 16, wherein both of the first and second contact portions 67*a*, 67*b* of the maintaining member 16 are two resilient latches. When the adjustment member 20 is moved to the first position relative to the maintaining member 16, the protrusion 90 of the adjustment member 20 contacts the first contact portion 67*a* and is positioned. When the adjustment member 20 is moved to the second position relative to the maintaining member 16, the protrusion 90 of the adjustment member 20 moves away from the first contact portion 67*a* and contacts the second contact portion 67*b* and is positioned.

In view of the foregoing, the user can adjust the adjustment member 20 to have damping function or not based on the user's requirement. That is to say, the present invention provides a mechanism for the user to easily and conveniently choose turning on or turning off the damping function of the damping device for the hinge assembly.

While we have shown and described the embodiment in accordance with the present invention, it should be clear to those skilled in the art that further embodiments may be made without departing from the scope of the present invention.

What is claimed is:

1. A hinge assembly comprising:

a housing having a chamber defined therein, an arm pivotably connected to the housing, a spring located in the chamber to provide a force to allow the pivotal movement between the housing and the arm;

a damping device having a maintaining member secured in the chamber of the housing and the maintaining member having a path, a damper located in the path and located corresponding to the arm, the damper having a piston rod;

an adjustment member movably connected to the maintaining member and having a protruded portion which is protruded into the maintaining member and located corresponding to the piston rod of the damper;

when the adjustment member is moved to a first position relative to the maintaining member, the protruded portion of the adjustment member is located toward the piston rod of the damper, when the housing is closed relative to the arm, the damper is pushed by the arm, so that the piston rod of the damper contacts the protruded portion of the adjustment member and retracts to perform damping function, and when the adjustment member is moved to a second position relative to the maintaining member, the protruded portion of the adjustment member is moved away from the piston rod of the damper, when the housing is closed relative to the arm, the piston rod of the damper cannot contact the protruded portion of the adjustment member, and no damping function is available.

2. The hinge assembly as claimed in claim 1, wherein the adjustment member has a protrusion, the maintaining member has a top portion which has a first contact portion and a second contact portion on a periphery thereof, when the adjustment member is moved to the first position relative to the maintaining member, the protrusion of the adjustment member contacts the first contact portion of the maintaining member, when the adjustment member is moved to the second position relative to the maintaining member, the protrusion of the adjustment member contacts the second contact portion of the maintaining member.

3. The hinge assembly as claimed in claim 2, wherein the first contact portion of the maintaining member is a fixed surface and the second contact portion of the maintaining member is a resilient latch.

4. The hinge assembly as claimed in claim 3, further comprising a resilient member connected between the maintaining member and the adjustment member, the adjustment member maintained at the first position in response to the resilient member.

5. The hinge assembly as claimed in claim 4, wherein the maintaining member has a first hook, the adjustment member has a second hook, and the resilient member is hooked between the first and second hooks.

6. The hinge assembly as claimed in claim 2, wherein both of the first and second contact portions of the maintaining member are two resilient latches.

7. The hinge assembly as claimed in claim 2, wherein the maintaining member has a bottom portion which has a curved lip on a periphery thereof, the maintaining member has a body connected between the top portion and the bottom portion, the adjustment member has a top piece, a bottom piece and a side panel connected between the top and bottom pieces, the top piece of the adjustment member contacts the top portion of the maintaining member, the bottom piece of the adjustment member contacts the lip of the bottom portion of the maintaining member.

8. The hinge assembly as claimed in claim 7, wherein the top piece of the adjustment member has an operation portion.

9. The hinge assembly as claimed in claim 7, wherein the top portion of the maintaining member has a first index and a second index, the top piece of the adjustment member has a tip, when the adjustment member is moved to the first position relative to the maintaining member, the tip points the first index, when the adjustment member is moved to the second position relative to the maintaining member, the tip points the second index.

10. The hinge assembly as claimed in claim 9, wherein the first index is represented by a description "ON" marked thereon and the second index is represented by a description "OFF" marked thereon.

11. The hinge assembly as claimed in claim 1, wherein the path of the maintaining member has a linear guide section defined in an inside thereof, the damper has a stop which is located to contact an end of the guide section.

12. The hinge assembly as claimed in claim 1, wherein the chamber of the housing has two positioning holes, the maintaining member has two engaging members on two sides thereof, the two engaging members are engaged with the positioning holes to secure the maintaining member in the chamber of the housing.

13. The hinge assembly as claimed in claim 1, wherein the chamber of the housing is defined by two side walls, an inner bottom, a front wall and a rear wall, the front wall is connected to a front end of the two side walls, the rear wall is connected to a rear end of the side walls, each of the side walls of the housing has a pivotal hole, the two pivotal holes are located adjacent to the front wall, the arm has two cam portions and a reception portion which is connected between the two cam portions, a pivot extends through the pivotal holes and the reception portion to pivotably connect the arm to the housing.

14. The hinge assembly as claimed in claim 1, wherein there are two springs which are torsion springs and each spring has a first leg, a second leg and a coil portion connected between the first and second legs, the housing has two pin holes in the side walls, the inner bottom has two lugs, each lug has a through hole which is located corresponding to the pin hole corresponding thereto, the springs are connected between the side walls of the housing and the lugs, a pin extends through one of the pin holes, one of the coil portions of the springs and one of the through holes of the lugs to connect one of the springs to the housing.

15. The hinge assembly as claimed in claim 14, wherein the two side walls each have an insertion hole and the two respective second legs of the two springs are inserted into the two insertion holes.

* * * * *